United States Patent [19]

Plannerer

[11] Patent Number: 4,708,828

[45] Date of Patent: Nov. 24, 1987

[54] CARBURETOR FOR IC ENGINES AND AN IDLING INSERT THEREFOR

[76] Inventor: Joseph Plannerer, Riesstr. 70, D-8000 München 50, Fed. Rep. of Germany

[21] Appl. No.: 853,507

[22] Filed: Apr. 18, 1986

[30] Foreign Application Priority Data

Feb. 14, 1986 [DE] Fed. Rep. of Germany ..... 3604715

[51] Int. Cl.[4] ..... F02M 3/10

[52] U.S. Cl. ..... 261/41.5; 261/121.3; 261/DIG. 81; 261/DIG. 78

[58] Field of Search ..... 261/DIG. 78, 41.5, 121.3, 261/DIG. 81

[56] References Cited

U.S. PATENT DOCUMENTS

| | | | |
|---|---|---|---|
| 1,736,239 | 11/1929 | Wilson | 261/DIG. 78 |
| 2,042,770 | 6/1936 | Chandler | 261/121 A |
| 2,418,011 | 3/1947 | Carlson | 261/DIG. 81 |
| 2,726,073 | 12/1955 | Seld | 261/DIG. 78 |
| 2,807,449 | 9/1957 | Manning, Jr. | 261/121 A |
| 3,235,236 | 2/1966 | Kalert, Jr. | 261/41 D |
| 3,235,237 | 2/1966 | Goetz et al. | 261/41 D |
| 3,931,369 | 1/1976 | Dale et al. | 261/DIG. 78 |
| 3,944,634 | 3/1976 | Gerlach | 261/41 D |
| 4,229,384 | 10/1980 | Karino et al. | 261/121 A |
| 4,349,489 | 9/1982 | Gaget et al. | 261/41 D |

FOREIGN PATENT DOCUMENTS

| | | | |
|---|---|---|---|
| 0036524 | 9/1981 | European Pat. Off. | 261/DIG. 78 |
| 2053991 | 5/1972 | Fed. Rep. of Germany | 261/DIG. 78 |
| 2202699 | 8/1973 | Fed. Rep. of Germany | 261/DIG. 78 |
| 1446469 | 8/1976 | United Kingdom | 261/DIG. 78 |
| 2115872 | 9/1983 | United Kingdom | 261/DIG. 78 |

*Primary Examiner*—Tim Miles

*Attorney, Agent, or Firm*—Cushman, Darby & Cushman

[57] ABSTRACT

A carburetor with an idling system is designed so that the full pressure differential or gradient available between approximately ambient pressure and the vacuum in the intake tube is employed for producing a critical pressure ratio of a supersonic flow in a laval nozzle. To make this possible, a fuel air emulsion formed with primary air is introduced from a mixing duct via a constricted orifice of a tubular nozzle at a bore constriction, at which there is always a sonic velocity when there is a critical and supercritical pressure ratio, into the secondary air flow where it is superfinely atomized in the secondary air flow, with a maximum velocity differential, aided by subsequent pressure surges. At least at a point far into the partial load range of operation, the idling system produces a homogeneous mixture which is homogeneously distributed in the intake tube with a practically molecular state of division so that it is even supplied to all cylinders of the engine and completely combusted with a minimum production of contaminants.

20 Claims, 3 Drawing Figures

CARBURETOR FOR IC ENGINES AND AN IDLING INSERT THEREFOR

BACKGROUND OF THE INVENTION

The present invention relates to a carburetor for IC engines. More specifically, the invention relates to a carburetor comprising an intake duct opening at one end into the atmosphere and connected at the other end with an intake pipe of a manifold of an IC engine. A throttle valve is located in the intake duct so as to essentially completely shut off same in an idling position, and an idling duct bypasses the throttle valve. The idling duct is formed to supply combustion air for the formation of a desired.fuel-air mixture, the fuel being caused to flow by vacuum of the combustion air at a fuel outlet from a fuel duct. The idling duct is formed with a bore constriction upstream from the outlet orifice of the idling duct in the intake duct for the production of a supersonic flow.

The invention also relates to an idling insert for such a carburetor which has a housing with a housing body for supporting a connector for fuel and a connector for combustion air. The insert comprises an inner fuel tube connected flow-wise with the fuel connector and an external jet tube connected flow-wise with the connector for combustion air. The jet tube extends, concentrically around the fuel tube with the formation of a support section for support in the carburetor housing, in a direction away from the housing body.

A carburetor of this type has been proposed in German Patent Specification No. 2,452,342. In this known carburetor, an idling duct was located within the material of the carburetor housing and primary air was supplied to the fuel in a vertically placed fuel duct through a branch duct arranged at an acute angle for the formation of an emulsion. At the lower end of the fuel duct the emulsion first passed into a plenum for transfer holes, which opened into the intake duct at the position at which the edge of the throttle valve made contact in its closed position. At the side of the plenum opposite the inlet, the fuel duct ran into a further plenum of the idling system, from which the fuel passed through a throttle duct, able to be set by means of a set screw and a projection on the throttle to change its cross section, to a mixing chamber for the addition and mixing of combustion air. On the side of the mixing chamber opposite to the throttle hole the fuel-air mixture passes into a small tube extending under the throttle valve a long distance into the intake duct and on its side adjacent to the mixing chamber it has a stepped choke structure which defines a bore constriction for producing a sonic velocity in the flow in the idling duct. The combustion air is supplied to the mixing chamber from an intake port in the wall of the intake duct over the throttle valve via a choke, which is responsible for the degree of vacuum requisite for causing flow of the fuel from the fuel duct.

The degree of vacuum produced in this way in the mixing chamber is considerable, since it has to cause the flow of the fuel out of the adjacent choke port at a velocity which, even initially, was relatively high, and such fuel has to be supplied on the other side of the mixing chamber to the narrow inlet of the choke structure without the mixing chamber being fouled by carbonizing condensate on its wall faces. This has to be achieved despite considerable pressure losses in the plenum chamber for the transfer holes and in the plenum chamber for the idling system with the throttle projection. Consequently, it is necessary for the degree of vacuum of the combustion air in the mixing chamber to be quite high.

On the other hand, however, the pressure in the mixing chamber always has to be just twice the pressure in the induction duct if a sonic velocity in the bore constriction is desired. Therefore, if one assumes a pressure in the mixing chamber of 0.75 bar, at which the flow of the emulsion caused is just adequate, the necessary pressure in the intake duct will be only approximately 0.4 bar at the most in order to attain a sonic velocity at the constriction with the ensuing relatively fine atomization desired. Although it may be possible under ideal conditions to construct this carburetor to attain this result during idling, this can be done only under the proviso that the degree of closing of the throttle valve is high and is not impaired by inaccuracies of manufacture or other factors, and under the further proviso that the rated idling speed of the engine is in fact attained; the idling speed may fall to a marked extent on switching on accessories requiring power such as an air conditioning system, a servosystem acting against an abutment or similar equipment and when this occurs the ideal conditions would no longer be fulfilled. A particular reason for such ideal conditions not being complied with is that, when changing over to a partial load phase of operation, the throttle valve is opened only a fraction so that the vacuum in the induction duct falls to some extent and the critical pressure ratio requisite for attaining sonic flow is no longer able to be reached.

The necessary consequence of this is that, even in the lower partial load range, desired fine atomization is no longer possible and, even during idling pure and simple, the set condition may very easily be lost so that even the automatic switching on of the air conditioning system may cause the engine to stop. However, in addition, even under ideal conditions which are not able to be permanently adhered to in practice at any rate for any length of time, there is only an incomplete amount of carburetion (in the sense of reducing the fuel droplet diameter down to an almost molecular order of size), because the combustion air exists at a low pressure and moves with a low velocity, and is combined in the mixing chamber with the emulsion (which also enters the mixing chamber as well with a relatively low velocity), such that, at the point of mixing, there will be no substantial effect to decrease the droplet diameter. Accordingly, the fuel-air mixture passes with a relatively large droplet diameter into the flow which is intended to be sonic, and it is only later that a reduction in the droplet diameter by the action of pressure waves is possible. Even if sonic flow is attained in the bore constriction, there will only be a limited degree of subsequent breaking down of the droplets in the mixture and if the sonic flow velocity is not reached, there will be a more or less complete absence of such breaking down of the droplet size.

From the original papers of German Pat. No. 2053991 issued to present inventor, it is also known to have an idling system using the transission between subsonic and supersonic flow to produce a vacuum for stimulating flow of fuel and air, and for intimate mixing and distribution thereof.

SUMMARY OF THE INVENTION

According to the teachings of the present invention, it is desirable to devise a carburetor of the type initially specified herein whose idling system assures stable running of the engine both during idling and also under partial load conditions and furthermore assures optimum preparation of the mixture and a homogeneous supply thereof to all cylinders.

In order to achieve this goal, at least the end of a fuel duct is in the form of a tubular nozzle placed in a concentric supply duct for the combustion air and the opening of the nozzle is placed at the bore constriction. Owing to the tubular nozzle form and the concentric arrangement of the fuel duct end in a combustion air feed duct, there is a concentric flow of combustion air around the fuel duct in the same direction as the fuel in this duct and also around the outlet orifice of such duct. This combustion air simultaneously serves for cooling the fuel and for avoiding the formation of vapor bubbles in the fuel which would make it non-homogeneous. Owing to the fact that the orifice of the tubular nozzle is arranged at the constriction in the combustion air duct the fuel is introduced into the combustion air flowing with a sonic velocity and is so broken down into superfine droplets, even during the process of mixing; furthermore pressure surges downstream from the point of admission and mixing lead to a further intensification of the mixing effect and of the homogenization of the mixture, as well as to a further reduction in the size of any large droplets still lingering on in the mixture. The overall effect is therefore that there is a more or less full and true physical gasification of the fuel in the mixture so that it is present therein with an almost molecular state of division.

The sonic velocity is produced at the constriction of the cross section with a high degree of certainty, more especially in the partial load range of operation as well, since, for attaining the critical pressure ratio, the entire pressure differential between more or less ambient pressure and the pressure in the intake duct is available, and, even in the case of a pressure increase in the intake duct to over 0.5 bar, it is still possible to ensure sonic velocity at the constriction in cross section. Even on a possible change over from a laval flow to a venturi one, under certain conditions of operation there will still be a very fine atomization and homogeneous mixing effect since only the sonic pressure surges will disappear, while the addition and mixing will still take place in such a way as to profit from the maximum velocity differential possible in this case.

Since, even with a high degree of vacuum in the intake duct at the bore constriction there will only be a sonic velocity (and not the supersonic velocity occurring only after flow through the bore constriction), there will be a very stable and constant mode of operation, for all pressure ratios above the critical ratio, with respect to the pumping of the fuel from the fuel duct with an automatically constant metering effect. On slowing down the engine, and when there is an extremely high vacuum downstream from the shut throttle valve (irrespective of the possibility of sudden turning off of the fuel supply), the amount of fuel will thus not be proportionately greater, this possibility being equally excluded even if the engine does not idle at a constant speed. Conversely, this stable manner of operation will also be adhered to in the partial load range providing that the pressure ratio does not go below the critical value owing to a pressure increase in the intake duct. In the case of any likely drop to a value below the critical pressure ratio and a change over to venturi flow, that is to say, for example on acceleration in the upper partial load range, there will admittedly be a change in the conditions of atomization, but all the same atomization will be optimum; and in this connection under such operating conditions no particular importance will be attached to a particularly homongeneous preparation of the mixture in the idling system.

Owing to the homongeneous and finely divided preparation of the mixture there is a correspondingly complete combustion process with a reduced emission of contaminants. Accordingly maximum engine power for a given fuel supply rate will be achieved with a minimized output of contaminants into the air.

European Patent No. 0 036 524 proposes a carburetion system for producing a sonic velocity in the narrowest cross section of a laval nozzle so as to ensure constant induction conditions in different load ranges under such carburetion conditions. The intention was, however, certainly to produce an air-rich emulsion upstream from the laval nozzle so that the emulsion would be aspirated as such without any addition of combustion air through the laval nozzle. If the sonic velocity is not attained this would then lead to a transfer of the fuel from the outlet orifice and to a corresponding formation of condensate. In the event of the sonic velicity being reached, there would be no remixing of the combustion air moving at sonic velocity with the emulsion introduced into such flow and a substantially worse preparation of the mixture would be probable than in the case of the carburetion system disclosed in the German Patent Specification No. 2,452,342 which is taken as a starting point for the carburetor disclosed herein.

In accordance with a preferred feature of the carburetor of the present invention means, such as ports, are provided for the introduction of primary air (for example upstream from the point of introduction of the fuel) into the fuel for emulsion formation. As a result, the carburetion system of the present invention entails a larger mass flow rate through the tubular nozzle, for conveying a given amount of fuel, than is the case when only fuel is caused to flow therethrough. In this case, it is possible to avoid having superfine nozzle orifices, which are difficult to manufacture, and at the same time the danger of fouling the tubular nozzle is minimized.

When, in accordance with a further feature of the carburetion system of the present invention, the fuel duct is in the form of a fuel tube placed bodily in the combustion air flow, there is not only a corresponding intensification of cooling by the surrounding air flow but furthermore the possibility of drawing in the primary air through at least one circumferential port in the wall of the duct for forming the emulsion. The arrangement and form of the ports may then be fully in accord with the desired primary air rate and distribution. The primary air supplied to the fuel also serves to cause further cooling of the fuel from the inside. The intensive cooling so ensured not only minimizes the danger of vapor bubble formation but at the same time increases the thermal efficiency. Since emulsion is not formed upstream of the fuel tube (which so serves as a mixing tube) it is more effectively possible to avoid separation of the air and fuel as components of the mixture than would be the case if the primary air were to be introduced at a point far upstream from the supply of the fuel or of the emulsion into the combustion air.

In keeping with a further feature of the carburetor of the present invention, there is a terminal bore constriction (more especially to a bore cross sectional area between 0.03 and 0.3 sq mm or preferably to about 0.12 sq mm) in the fuel duct for the emulsion with a relatively small, but not extremely small, size. As a result, in view of the present strong vacuum, there will be an effective control of the desired metering of the fuel without any excess thereof.

Since no throttling of the supply of fuel is aimed at upstream from the fuel duct (such throttling would otherwise cause unnecessary losses in the flow), it may be, in order to draw in a defined and desired amount of primary air, an advantage in addition to suitably dimensioning the ports in the wall of the duct to have a pre-choke upstream from such ports in order to ensure a suitable degree of vacuum in the fuel duct. This pre-choke may be in the form of a constriction of the fuel duct to a reduced bore area (more specifically to an area of 0.03 sq mm to 0.3 sq mm and preferably 0.12 sq mm) in tune with the desired pressure and flow conditions sought. As a rule, the optimum cross sectional area will be the same as that of the constriction in the tubular nozzle, it having however to be taken into account that in the assumed preferred case the nozzle is for emulsion while the pre-choke constriction is for fuel alone.

The port or ports in the fuel tube are intended, under the pressure conditions which become established, to meter in a certain amount of air to mix with the fuel and form the emulsion, and may then preferably have a total cross section of between 0.1 sq mm and 1.0 sq mm or, more especially, approximately 0.45 sq mm. In place of a single large port it is more expedient to have a plurality of small ports, which are more readily produced with the desired cross sectional area as part of the process of manufacture, and which prevent any unintentional discharge of fuel under transient conditions, more especially if they are on the top side of the fuel tube.

The preferred dimensions of the separate bore constrictions of 0.03 sq mm to 0.3 sq mm (preferably 0.12 sq mm) for the tubular nozzle, of 4 sq mm to 40 sq mm (preferably approximately 16 sq mm) for the supply duct for combustion air, of 0.03 sq mm to 0.3 sq mm (preferably approximately 0.12 sq mm) for the pre-choke and of between 0.1 sq mm and 1.0 sq mm (preferably approximately 0.45 sq mm) for the port for the entry of primary air, result in optimum running conditions for a 2.8 liter engine. For engines with other cubic capacities the optimum values within the ranges set forth above will be larger or smaller, although the relationship between the dimensions will be substantially the same.

Despite the absence of air ports in the fuel line in view of the introduction of primary air only at the outlet end of the idling duct, in order to safely prevent the drawing in of fuel from the float chamber during pauses in operation, it is possible to have a valve for shutting off the fuel line (more specifically at a point upstream from the fuel tube) automatically. If this valve is placed as close as possible to the outlet of the idling duct, this will also serve to minimize the amount of fuel which necessarily drips out of the fuel duct when there is a pause in operation.

In keeping with a further feature of the carburetor of the present invention, it is expedient to have the air duct and/or the fuel duct of the idling duct in the form of tubes standing free of the carburetor housing. Apart from the reduction in design and manufacturing costs being less than for carburetors having the ducts within the carburetor housing, this means that with regard to the air duct, there will be a respective freedom with regard to the design of the upstream connection of the air line which does not have to be directly connected with the air filter, but may also be in the form of a branch from the cylinder head air vent duct so that even at a point upstream from the air filter it is possible for the oil mist in the filter to be drawn off, possibly with the addition of air from the air filter which is drawn through the section, leading to the air filter, of the cylinder head venting duct.

With regards to the fuel duct, the design in the form of a duct standing out from the side of the carburetor housing gives the special advantage of cooling the hot fuel drawn in from the float housing. This is more especially of value in countering hot start problems.

In order to prevent an excessive amount of heat being transferred from the hot wall of the carburetor to the downstream end of the fuel line, something that would be prone to cause irregular operation owing to the formation of bubbles of vapor in the fuel line, the latter duct may end in a connector supported in a connecting part of material with a low thermal conductivity, more especially plastic. This avoids the direct transfer of heat from the hot metal parts.

As part of a further feature of the carburetor of the present invention, the fuel line is arranged to terminate in the connector with its axis placed transversely in relation to the axis of the fuel duct, this making it possible to save space here as is usually desired.

In accordance with still a further feature of the carburetor of the present invention, the arrangement serves to form an annular trap chamber for any small vapor bubbles tending to move back out of the fuel pipe and likely to coalesce as large vapor bubbles causing irregular running if they are allowed to get into the fuel line. The connector extends downwards through the trap chamber to form its inner wall face. The inlet port of the fuel duct is placed to the side above the level of the outlet orifice of the connector. Any small vapor bubbles tending to move out of the fuel tube are thus caught in the trap chamber and stopped from transferring into the lower outlet orifice of the connector of the fuel line so that there is no interruption in the continuous supply of the fuel therethrough. The vapor bubbles whose size are in any case limited to the volume of the trap chamber, may be drawn again into the fuel duct during the course of further flow of the fuel and may emerge with the fuel or the emulsion thereof without causing any irregularity, from the fuel duct into the combustion air flow.

In accordance with an even further feature of the carburetor of the present invention, the arrangement is such that the cross section of the flow of fuel from the flow chamber to the inlet port of the fuel tube, that is to say the cross section of the fuel line, of the connector thereof, of its outlet orifice, of the trap chamber and of the point of transfer from the outlet orifice to the trap chamber, is at least approximately constant. This results in an even flow velocity and an insensitivity with respect to transients such as vibrations, different slopes on traveling up and down hill, the formation of dead zones and the like.

For not only simplifying production, but more especially to make possible fitting to existing systems, it is possible for the outlet part, having the fuel duct of the idling duct, to be in the form of a separate housing, which has a nozzle tube (forming the combustion air duct) adapted to be fitted to extend through the wall of the carburetor housing and/or of the intake duct, respectively, as for example at a position adjacent to a base plate of the carburetor.

Adaptation to suit the respective operating conditions may be made possible by providing adjustable means for securing the precise position of the port of the fuel duct in relation to the cross section bore constriction in the combustion air duct so that, if required, fine adjustment may be undertaken on any IC engine without, normally, any later adjustment being needed.

In order to ensure a particularly low loss inlet flow and efficient acceleration into the supersonic range before detachment and flow transition take place, the bore constriction in the combustion air duct may be in the form of a converging-diverging laval nozzle.

As a further feature of the carburetor of the present invention, the axis of the outlet part of the idling duct may be at an angle of 0° to 30° and more especially at an angle of at least about 10° to the center axis of the intake duct.

Furthermore, the axis of the outlet part of the idling duct may be at an angle (as seen in a horizontal plane) of 15° to 40° and more especially of about 20°. to a line drawn radially from the center axis of the intake duct, such angle being measured at the point of intersection of the axis of the outlet part of the said idling duct with the prolongation of the outer face of the intake duct.

With such slopes of the axis of the outlet part of the idling duct in a downward and in a lateral direction towards a more tangential flow it is possible to minimize the vacuum at the outlet orifice of the idling duct and to optimize the mixing effect, more particularly in the partial load range. The introduction of the mixture from the idling system, with a high velocity but with a limited mass flow rate therefore, has the tendency to keep the mixture flowing in a helical flow path running downwards in the intake duct or pipe, respectively, this favoring a progressively complete mixing with the mixture flowing past the throttle valve with minimum flow losses. While the downward slope more especially makes a contribution to minimizing the flow losses and, in the partial load range, to increasing the local vacuum at the outlet orifice of the idling duct the inclination to the side is more especially helpful with regard to improving the mixing effect; since at this point in time the fuel is already in a practically "carbureted" or gasified form, there is little risk of centrifugal separation of fuel droplets and the formation of condensate, more especially since the flow at the same time enters the substantially widened intake tube owing to the downward motion.

In accordance with still another feature of the carburetor of the present invention, a housing is provided having a housing body for supporting a connector for fuel and a connector for combustion air as well as an inner fuel tube connected with the fuel connector for flow therebetween, and an outer nozzle tube connected with the combustion air connector for flow therebetween, the nozzle tube extending away from the housing body concentrically around the fuel tube to form a support portion for the support of the carburetor housing.

This feature of the carburetor of the present invention constitutes an idling insert fitting which is a separate and compact part produced separately from the carburetor so that it may be sold for modification of a preexisting carburetor. This possibility of production and distribution of such separate components has a special degree of importance as part of the present invention, since it makes possible the use of the teachings of the invention independently from mass produced articles coming from automobile and carburetor manufacturers so that the invention may be put into practice at the option of the consumer or car owner and he or she may make his own contribution to economizing in the use of energy and protecting the environment.

Furthere details, features and beneficial effects of the carburetor of the present invention will be apparent from the following description of one working embodiment thereof.

DESCRIPTION OF THE PREFERRED EMBODIMENT

Figure 1:
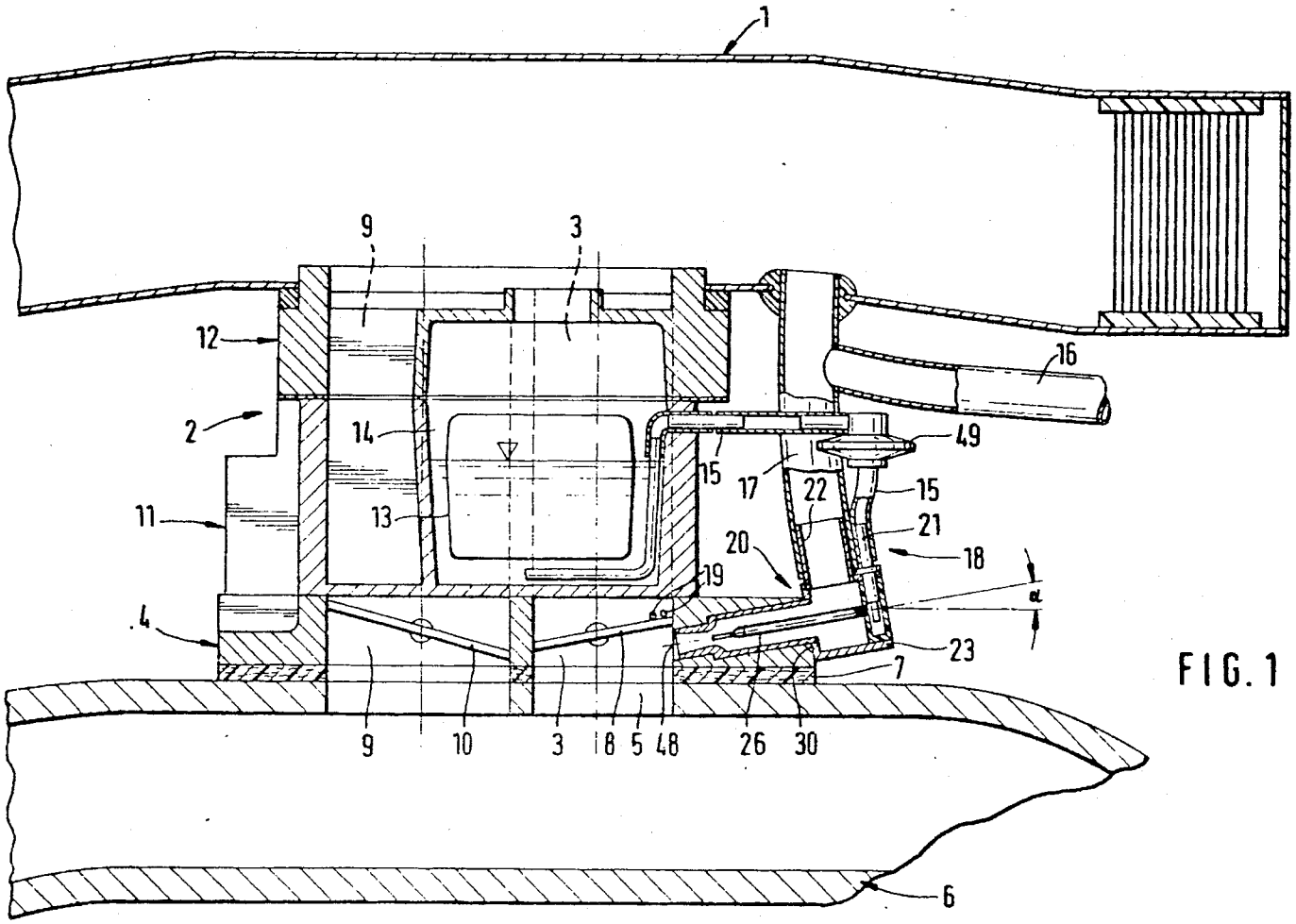
FIG. 1 is a diagrammatic and simplified generally vertical sectional view of a carburetor constructed according to the teachings of the present invention.

A carburetor is shown in FIG. 1 with an air filter 1, a carburetor housing 2 and an intake duct 3 passing through the housing 2 for the aspiration of outside air through the air filter 1. The carburetor housing 2 includes a base plate 4 for connection with an intake pipe 5 of an intake manifold 6, which supplies the cylinders of an IC engine in a conventional manner with fuel-air mixture and on which the base plate 4 is mounted using a conventional gasket 7.

A butterfly throttle valve 8 is located in the intake duct 3 so as to practically fully close the intake duct 3 in the idling setting.

The carburetor shown is in the form of a governor carburetor and has an intake duct 9 of a second stage, whose throttle valve 10 starts to open when there is a substantial increase in the engine speed.

In a conventional manner, the carburetor housing 2 is produced as a casting and in addition to the base plate 4 has two superposed housing parts 11 and 12, the section in FIG. 1 being such as to run along the axes of the intake ducts 3 and 9 in the base plate 4, while on the other hand adjacent to the housing parts 11 and 12 it runs through a plane in front of it extending through a float chamber 14.

Under the control of a float 13, fuel moves into the float chamber 14, whence the fuel is abstracted via a fuel line 15 in the form of a stiff or flexible pipe 15 standing free from the side of the carburetor housing 2. Oil mist, as produced in the crank case and the entire engine block, is supplied through a cylinder head vent line 16 to the air filter 1. In the illustrated embodiment, the cylinder head vent line 16 does not run directly to the air filter 1 but into an air line 17 connected with the air filter 1. The fuel line 16 and the air line 17 form parts of an idling duct structure generally identified with reference numeral 18, with which the fuel and the air may be supplied to an idling system opening into the intake duct 3 downstream from the throttle valve 8.

The other features of the carburetor, as for example an accelerating pump, may be of a conventional design and are therefore not in need of explanation here. It does, however, remain to be stressed that the throttle valve 8 of the carburetor of the present invention has to stand in a setting in which it practically completely shuts off the intake duct 3 of a first stage so that essentially no air flow is possible past the edge of or through the throttle valve 8 and there are no ducts, or at any rate no open ducts, which would lead to leakage of air. At the edges of the throttle valve 8 in its idling setting it is posssible to have conventional transfer ports 19, if there is no other transfer system, for the supply of mixture in the transitional stage of operation between idling and partial load.

Figure 2:
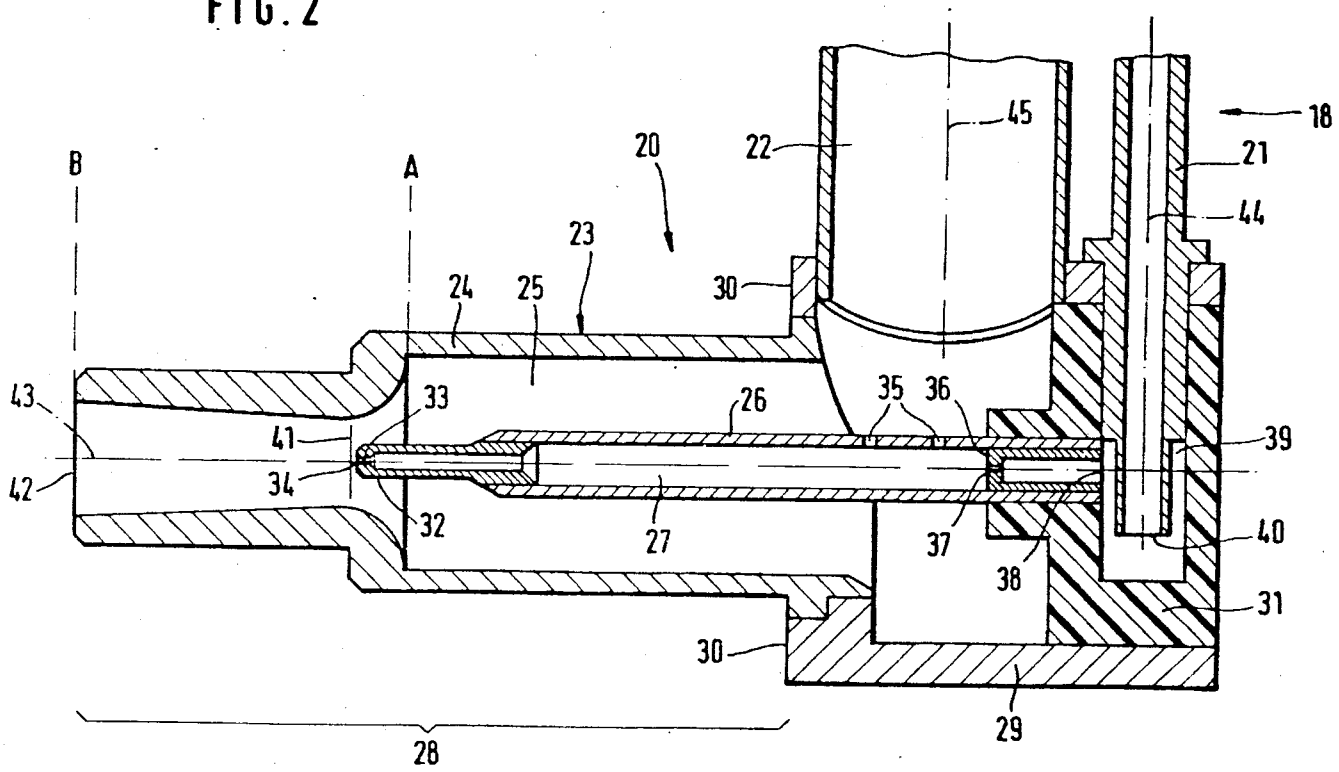
FIG. 2 is an enlarged longitudinal section through the outlet part of the idling duct of the carburetor shown in FIG. 1.
Figure 3:
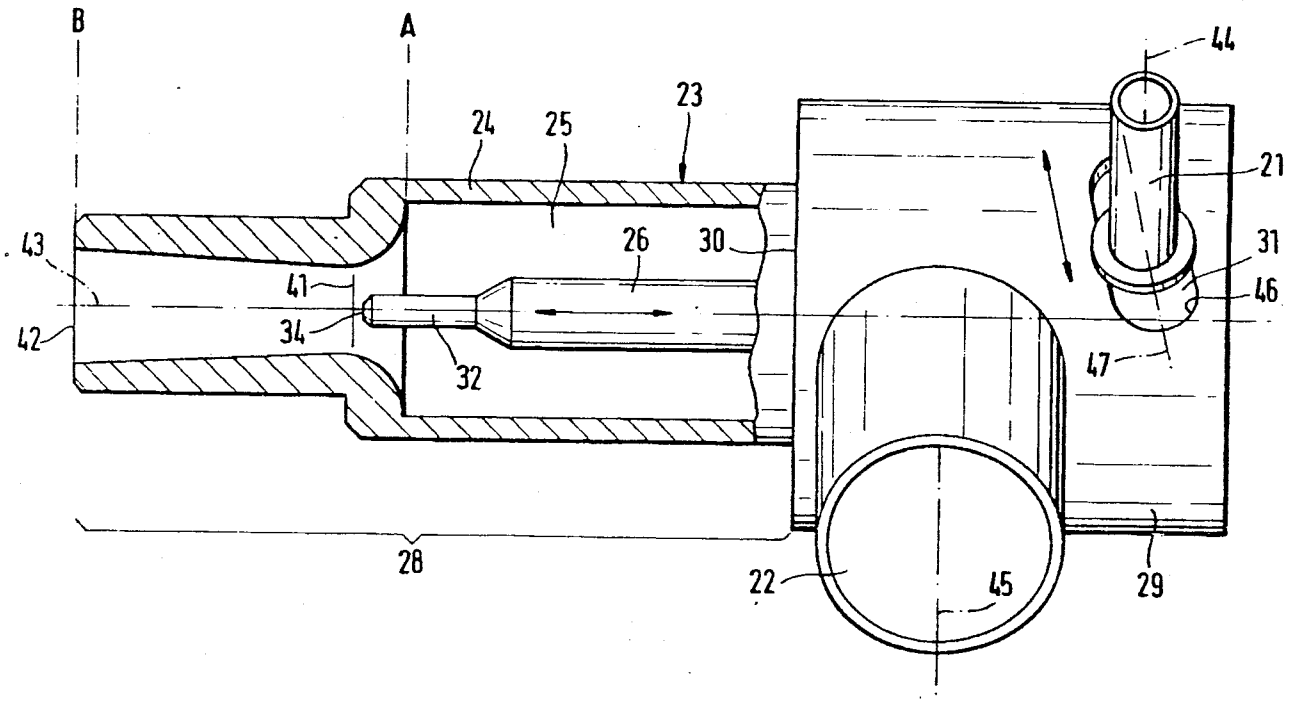
FIG. 3 is a top plan view, partially in section, of the outlet part of the idling duct shown in FIG. 2 viewing same from above.

The outlet part 20 of the idling duct structure 18 is shown in more detail in FIGS. 2 and 3. As shown in these Figures, the fuel line 15 comes to an end in a connector 21 and the air line 17 ends in a connector 22, the connectors 21 and 22 being supported in a housing 23, which essentially consists of a jet nozzle tube 24 for the formation of a supply duct 25 for the combustion air around a fuel tube 26, which forms a fuel duct 27. Furthermore, adjoining a supporting portion 28, formed essentially by the nozzle tube 24 to fit into the carburetor wall 2, the housing 23 comprises a rear housing body 29 adjacent to the connectors 21 and 22 with end faces 30 next to the supporting portion 28 and a connection part 31 of material with a low thermal conductivity as for example plastic in the instant case, whereas all other parts are made of metal.

At its front end, the fuel tube 26 has a tubular nozzle 32 with a bore constriction 33 having a cross section of, for instance, 0.12 sq mm, the same also forming a port 34 for the emergence of fuel or emulsion, as the case may be. In its rear top part the fuel tube 26 has round, axially spaced, ports 35 which, in the present example, are two in number and have a diameter of 0.5 mm and 0.6 mm, respectively, that is to say with a sum cross section of approximately 0.45 sq mm. Such ports make possible flow of the air from the flow around the fuel tube 26 into the fuel duct 27 so that a fuel emulsion is formed therein. A pre-choke 36 is located upstream from the ports 35 and in the present example it is in the form of bore constriction 37 with a cross sectional area of 0.12 sq mm.

The fuel duct 27 opens, by way of an inlet port 38, into a trap chamber 39 through which the connector 21 of the fuel line 15 extends and which is machined in the connection part 31 of plastic. An outlet port 40 of the connector 21 is in this case lower than the lower edge of the inlet port 38 of the fuel duct 27 and therefore also at a lower level than the trap chamber 39 so that on the supply of fuel from the outlet port 40 of the connector 20 via the trap chamber 39 into the inlet port 38 of the fuel duct 27 there is a sort of inverted syphoning effect.

The tubular nozzle 32 with the bore constriction 33 of the fuel tube 26 is placed in a constriction 41 upstream from an outlet port identified by reference numeral 42, of the idling duct structure 18 into the intake duct 3. The constriction 41 is in this respect in the form of a sort of convergent-divergent laval nozzle so that if a critical pressure differential or ratio between the planes A and B is exceeded in the constriction 41, there will be a flow with a sonic velocity and in the following somewhat diverging part of the nozzle tube 24 there will be a supersonic velocity, until detachment and flow transition occur. In the case of a supercritical pressure differential this will be, at the latest, in the plane B, that is to say in the plane of the outlet port 42. In the present example, the bore constriction 41 has an area of cross section of approximately 16 sq mm, this being believed to be the size for optimum operation of a 2.8 liter engine.

The fuel tube 26 and the nozzle tube 24 are placed concentrically about an axis 43 that intersects the axis 44 (which is perpendicular to it) of the connector 21 of the fuel line 15. Furthermore the axis 45 of the connector 22 of the air line 17 is perpendicular to the axis 43 but does not have to intersect with it.

As shown in FIG. 3, the connection part 31 together with the fuel tube 26 is swivel mounted in the housing body 29, with corresponding turning of the connector 21 being provided for since the connector 21 runs in a slot 46 in the housing body 29. The axis 47 of the slot 46 is not perpendicular but is at an angle to the axis 43 so that the swivel movement of the connection part 31 and of the fuel tube 26 with a rocking of the connector 21 also leads to an axial motion of the fuel tube 26. This makes possible accurate adjustment of the position of the port 34 of the tubular nozzle 32 in relation to the constriction 41 in accordance with specific requirements. In the present case, the length of the slot 46 is intended to allow a twist of the connection part 31 of 30° and is set at an angle of 13° obliquely in relation to the axis 43 so that the amount of adjustment is of the order of 1 mm.

For assembly in the position shown in FIG. 1, it is possible for the entire nozzle tube 24 to be inserted into a suitable hole in the carburetor housing 2 until it abuts the front end faces 30 of the housing body 29. As already indicated, in connection with the description of FIG. 1, the axis 43 may be inclined at an angle to the horizontal, the angle having a possible range of approximately 0° to 30° and in the present case it may have a value of 10° owing to design limitations occasioned by the overall height of the base plate 4. In a manner which is similar, but which is not illustrated, the axis 43 does not have to intersect with the center axis of the intake duct 3 and it is possible for there to be an oblique setting of the axis 43 clear of the radial setting such that the emergency of the flow from the outlet port 42 is more tangentially directed into the interior of the intake tube 3. Such an angle to the radial direction may be between 15° and 40° and, in the present case, may be taken to be 20° as measured at the point of interference, generally identified by reference numeral 48 in FIG. 1, of the axis 43 with the extension of the outer face of the intake duct 3.

During idling the throttle valve 8 is closed so that the vacuum produced in the intake duct 3 downstream from the throttle valve 8, owing to the intake strokes of the pistons, acts in full on the outlet port 42 and through the latter in the idling duct structure 18. The result is that air is firstly drawn in through the air duct 17 and the oil mist present in the cylinder head vent line 16 will be entrained as well, such mist being supplemented by air from the air filter 1. This air current will only undergo a small drop in pressure so that the pressure in the plane A will be more or less atmospheric and at the intake duct 3 adjacent to the outlet port 42 there will be, for example, a pressure of only 0.4 bar. This means that the critical pressure ration between the planes A and B has been substantially exceeded so that a sonic flow will establish itself in the plane of the constriction 41 and will be followed by a supersonic flow.

Owing to the marked pressure drop in the inlet part of the bore constriction 41 and the change over from static pressure into dynamic pressure of the air flow, there will be a correspondingly intense suction effect on the fuel thereat through the port 34 of the tubular nozzle 32 and fuel therefore will be supplied through the constriction 33 to the air flow at a metered rate. At the same time, however, primary air will be drawn from the air flow around the connector 22 through the ports 35 at a point upstream from the tubular nozzle 32 and introduced into the fuel tube 26 where it will form a fuel air emulsion with the fuel in the fuel tube. Thus, at the port 34, the fuel in the form of such an emulsion will pass into the combustion air flowing in the supply duct 25, such entry being at a position at which there is an extremely large velocity differential owing to the sonic velocity of the combustion air. As a result, the fuel, emerging with a very much lower velocity, will be broken down into very small droplets and atomized so that downstream from the constriction 41 there will be a fuel-air mixture with the desired lambda value having a very homogeneous distribution, at least at the outlet port 42. At the latest, at the outlet port 42 there will then be a further disintergrating effect on any large droplets still present owing to the pressure surge when there is a flow transition to an ultrasonic value. In the manner indicated in FIG. 1, a flow emerges downwards and sideways from the outlet port 42 and passes into the intake tube 3. It flows turbulently through the tube 3 and fills it very rapidly and homogeneously with finely divided fuel in particles with a more or less molecular order of size.

This condition remains unchanged as long as the critical or supercritical pressure differential is maintained between the planes A and B, in which respect even a highly supercritical pressure differential or ratio hardly causes any change in the atomization state at the constriction 41, since the velocity is always supersonic at this position. In the event of the pressure differential being subcritical under full load or in transient conditions, as for instance during acceleration, the part of the nozzle tube 24 between the planes A and B will function as a venturi tube, in which respect, however, the supply of the fuel will be at the point of maximum velocity differential between the combustion air flow and the fuel so that, in these conditions as well, optimum atomization still takes place, although it is of only slight importance under such load conditions. It is, however, important that in steady state conditions, a critical pressure ratio exist far into the partial load range so that the ideling mixture will be supplied under constant, stable conditions. Furthermore, the oil mist from the cylinder head vent duct 16 is supplied to such idling mixture in the way indicated directly, or via the air filter 1, so that the mist is dealt with in a manner conducive to economy in energy and to protection of the environment.

Since the fuel is supplied via the fuel line 15 without any notable pressure losses, it may be expedient to step up the degree of vacuum in the fuel duct 27 at the port 35 in order to guarantee the requisite input of primary air. This is made possible by the pre-choke 36, the cross sectional area of the constriction 37 thereof being adapted, on the one hand, to the desired pressure drop and, on the other hand, to the overall pressure drop as far as the port 34, in order to attain a desired exit velocity for the emulsion. Typically, the size of the area of the constriction 37 will be, dependent on the engine cubic capacity, between 0.03 sq mm and 0.3 sq mm. In view of the selected cross section size of 0.12 sq mm of the constriction 33 through which the emulsion flows, in the present example, a cross section size of 0.12 sq mm can be selected for the constriction 37 having fuel alone flowing through it. In the case of the selected summated cross section of the ports 35 of approximately 0.45 sq mm there will be an optimum formation and propulsion of the emulsion through the tubular nozzle 23 under the action of the combustion air, which always flows through the constriction 41 with a sonic velocity. A size of the cross section at the constriction 41 of approximately 16 sq mm then leads to a supply of combustion air to the flowing fuel at such level as to ensure a properly ignitable mixture and at such a rate that, in the case of a 2.8 liter engine the idling speed, will be 600 to 700 rp.

The choking constrictions 33 and 37 are not able to prevent fuel syphoning from the float chamber 14 of its own accord if the engine stops, since access of air into the fuel line 15 is not possible upstream from the connector 21. For this reason the fuel line 15 is provided with a valve 49 which automatically shuts off the fuel line 15 below a head, for instance, of 4 cm of gasoline in the line. Therefore, at the most, only dribbling of fuel downstream from the valve 49 will be possible. The volume of such fuel may be minimized and, owing to the complete shutting off at the level of the valve 39, it will only be able to flow (if at all) slowly; it is in this way that the amount of fuel leaking, in the case of the illustrated form of the carburetor of the present invention, may be limited to the content of the fuel tube 26 downstream from the ports 35.

The connection part 31 made of material with a low thermal conductivity prevents any substantial transfer of heat between the hot peripheral wall of the housing body 29 and the connector 21 and also the fuel tube 26, it being significant in this respect that the connector 21 is fitted in the slot 46 with some lateral play. This means that the cooling of the fuel tube 25 by the surrounding combustion air flow in the supply duct 26, and also by the primary air drawn in through the ports 35, still will be effective, even in the rear part of the fuel tube 26, so that the same will be relatively cool even at the inlet port 38.

Transfer of any vapor bubbles, nevertheless formed in the fuel tube 26, into the fuel line 15 is prevented by the trap chamber 39, since vapor bubbles tending to move back towards the fuel line 15 will be retained at the uper wall of the trap chamber 39 until they are moved (perhaps after increasing somewhat in size and bulging to a greater extent down into the fuel space) back into the fuel tube 26 and leave it together with the fuel or the emulsion (as the case may be) via the port 34, something that does not give rise to any irregularities in operation. Owing to the fact that the cross section area of the fuel line 15, of the connector 21, of the annular trap chamber 39 and of the transition between the outlet port 40 and the trap chamber 39 have been designed to be generally equal in size, there will be a regular flow of the fuel between the float chamber 14 and the inlet port 38 of the fuel tube 26 and such flow will be unlikely to be disturbed, and more especially in the case of a relatively high flow velocity through a small cross section, will make a substantial contribution to avoiding the formation of vapor bubbles, even under very unfavorable conditions.

The working example of the carburetor of the present invention described above leads to the advantages described initially herein; a more significant point, in this respect, is that the relatively high pressure at the plane A makes it possible for the critical pressure ratio to be maintained far into the partial load range so that consequently more regular operation of the idling system may be ensured. Since, furthermore, in the partial load range as well, a corresponding flow is maintained through the idling system, and such flow may certain constitute a substantial part of the fuel-air mixture made available for the cylinders, the optimum operation, at any rate, of this part leads to a significant increase in mileage and a drop in contaminant emission in the partial load ranges as well.

For achieving a maximum vacuum in the idling setting the throttle valve 8 can be fully closed in this position—with the possible exception of small gaps caused by manufacturing tolerances. This position of the throttle valve 8 in the idling setting does also form the basis for the indicated metering of the ducts of the idling system.

However, a certain problem might arise if the transfer port 19 which is usually provided as concentrical elongated slot is also shut off completely in this position by the edge of the throttle valve 8 from the vacuum below the throttle valve 8, since then, with the transition to the partial load range, there may occur a nonsteady phase with a fuel supply reduced as against the desired value because of said load, i.e., an "acceleration gap", since the flow of the transfer port 19 proceeding from the previous zero-flow starts with delay.

For avoiding such nonsteady states of operation it can also be provided that the edge of the throttle valve 8 comprises a small gap with a maximum diameter of e.g. 0.2 to 0.3 mm to the wall of the intake duct 3 in the idling setting, i.e. that the throttle valve 8 does not completely shut off the flow in the intake duct 3 but only throttles it. In such a case there is, also in the idling setting, a certain basic flow of fuel and/or emulsion from the transfer port 19 and a corresponding air supply from the intake duct 3. With an appropriate compensation of said additional fuel and air supply by a respectively reduced fuel and air supply from the idling duct means 18 there are the same operating conditions as with the above embodiment.

The carburetor of the present invention has a number of advantages, some of which have been described above, and others of which are inherent in the invention. Also modificaitions can be made to the carburetor of the present invention without departing from the teachings of the present invention. Accordingly the scope of the present invention is only to be limited as necessitated by the accompanying claims.

I claim:

1. A carburetor for an IC engine comprising an aintake duct (3) opening at one end into the atmosphere and connected at the other end with an intake pipe (5) of a manifold (6) of an IC engine, a throttle valve (8) located in said intake duct (3) so as to at least essentially shut off said intake duct (3) in an idling position, and idling duct means (18) bypassing said throttle valve (8), said idling duct means including feed duct means (24) for supplying combustion air for the formation of a desired fuel-air mixture, said means for supplying including a fuel duct means and a fuel outlet orifice connected to said fuel duct means (27), said idling duct means (18) being formed with a bore constriction (41) upstream from said outlet orifice (42) of the idling duct means (18) in the intake duct (3) for the production of a supersonic flow, and characterized in that said fuel duct means (27) is in the form of tubular nozzle (32), said fuel duct means being disposed within said feed duct means for the combustion air, said tubular nozzle being located concentrically in said feed duct means (24) for the combustion air, said tubular nozzle being connected to a tube (26) with said tube having at 1east one peripheral port (35) for the inlet of combustion air, said tubular nozzle having said outlet orifice (34) which is located in said bore constriction (41) and said outlet orifice being located adjacent a sonic Laval plane defined by said bore constriction, said concentric feed duct means having a downstream end relative to said orifice (34) which includes a diverging portion for containing supersonic flow under Laval conditions.

2. The carburetor as claimed in claim 1, characterized in that the tubular nozzle (32) has a terminal bore construction (33) down to a bore cross sectional area of between approximately 0.03 sq mm and 0.3 sq mm.

3. The carburetor as claimed in claim 1 characterized in that the bore construction (41) of the feed duct (25) for combustion air has a free bore with a cross sectional area between approximately 4 sq mm and 40 sq mm.

4. The carburetor as claimed in claim 1, characterized by a pre-choke (36) upstream from the port (35) for ensuring a degree of vacuum in the fuel duct (27) for causing the entry of the primary air.

5. The carburetor as claimed in claim 4 characterized in that the pre-choke (36) is in the form of a bore construction (37) in the fuel duct (27) which has a bore cross sectional area between approximately 0.03 sq mm and 0.3 sq mm.

6. The carburetor as claimed in claim 1 characterizxed in that the total bore area of the one or more ports (35) is between approximately 0.1 sq mm and 1.0 sq mm.

7. The carburetor as claimed in claim 1 characterized by a valve (48) in the fuel line (15) for shutting off the fuel line (15) upstream from the fuel tube (26) when operation of the carburetor is interrupted.

8. The carburetor as claimed in claim 1 characterized in that the air line (17) and/or the fuel line (15) of the idling duct means (18) are in the form of lines standing free of the side of the carburetor housing (2).

9. The carburetor as claimed in claim 8 characterized in that the fuel line (15) ends in a connector (21) which is supported in a connecting part of material which has a low thermal conductivity.

10. The carburetor as claimed in claim 9 characterized in that said connector part is made of a plastic material.

11. The carburetor as claimed in claim 9 characterized in that the fuel line (15) ends in the connector (21) so that its axis (44) is transverse in relation to the axis (43) of the fuel duct (27), in that the outlet orifice (40) of the connector (21) of the fuel line (15) is placed at a lower level than the inlet port (38) of the fuel duct (27) and in that, between the outlet orifice (40) of the connector (21) and the inlet ports (38) of the fuel duct (27), there is an annular trap chamber (39) for vapor bubbles.

12. The carburetor as claimed in claim 11 characterized in that the cross sectional bore areas of the fuel line (15), of the associated connector (21), of its outlet orifice (40), of the trap chamber (39) and of the connection between the outlet orifice (40) and the trap chamber (39) are at least approximately equal in size.

13. The carburetor as claimed in claim 1 characterized in that the end having the fuel duct (27) of the idling duct means (18) is in the form of a separate housing (23), which has a tubular nozzle (24) forming the combustion air feed duct (25) and which extends through the housing (2) of the carburetor or of the air intake duct (3).

14. The carburetor as claimed in claim 1 characterized by having means for adjusting the position of the orifice (34) of the fuel duct (27) in relation to the bore construction (41) of the feed duct (25) for the combustion air.

15. The carburetor as claimed in claim 1 characterized in that the part forming the bore construction (41) of the feed duct (25) for combustion air is in the form of a converging-diverging laval nozzle.

16. The carburetor as claimed in claim 1 characterized in that the axis (43) of the outlet part (20) of the idling duct means (18) is inclined downwards in relation to the center axis of the intake duct (3) at an angle of between approximately 0° and 30°.

17. The carburetor as claimed in claim 16 characterized in that said angle is at least approximately 10°.

18. The carburetor as claimed in claim 1 characterized in that the axis (43) of the outlet part (housing 23) of the idling duct means (18), at the point of intersection (48) of the axis (43) of the outlet part (20) of the idling duct means (18) with the prolongation of the outer face of the intake duct (3), makes an angle in relation to a line radial to the center axis of the intake duct (3) and in a horizontal plane of between approximately 15° and 40°.

19. The carburetor as claimed in claim 18 characterized in that said angle is approximately 20°.

20. An idling insert for a carburetor comprising a housing (23) with a housing body (29) supporting a connector (21) for fuel and a connector (22) for combustion air, said insert comprising an inner fuel tube (26) connected flow-wise with the fuel connector (21) and an external jet tube (24) connected flow-wise with the connector (22) for combustion air, said jet tube (24) extending concentrically around the fuel tube (26) with the formation of a support section (28) in the carburetor housing (2), in a direction away from the housing body (29).

* * * * *